United States Patent [19]

McLaughlin et al.

[11] 4,251,009

[45] Feb. 17, 1981

[54] SECURITY DOOR ASSEMBLY FOR AN AUTOMATIC DOCUMENT DISPENSING DEVICE

[76] Inventors: Richard S. McLaughlin, 13410 Purple Sage, Dallas, Tex. 75240; Jerome A. Moore, 1820 Plymouth Rock, Richardson, Tex. 75081

[21] Appl. No.: 892,748

[22] Filed: Apr. 3, 1978

[51] Int. Cl.[3] ..... E05G 7/00

[52] U.S. Cl. ..... 221/12; 49/28; 49/340; 109/19; 194/DIG. 26

[58] Field of Search ..... 221/12; 194/DIG. 6, 194/DIG. 9, DIG. 26; 109/19, 24.1, 66; 232/44; 49/26, 28, 340

[56] References Cited

U.S. PATENT DOCUMENTS

| | | | |
|---|---|---|---|
| 1,673,882 | 6/1928 | Platt | 109/19 |
| 1,885,165 | 11/1932 | Willems | 109/19 |
| 2,730,053 | 1/1956 | Ellithorpe | 232/44 X |
| 2,902,114 | 9/1959 | Ellithorpe | 109/19 |
| 3,237,933 | 3/1966 | Grosswiller et al. | 49/28 |
| 3,357,133 | 12/1967 | Helsing | 221/12 X |
| 3,390,833 | 7/1968 | Harris | 232/43.3 |
| 3,682,113 | 8/1972 | McClellan et al. | 109/19 |
| 3,784,090 | 1/1974 | Markham | 232/44 |
| 3,901,366 | 8/1975 | Schuller et al. | 221/12 |
| 3,957,173 | 5/1976 | Roudebush | 194/DIG. 26 |

*Primary Examiner*—F. J. Bartuska

[57] ABSTRACT

A security door assembly for use in an automatic document dispensing device having a user access compartment for conveying documents to a user through an opening in the user access compartment is provided. The security door is pivotally mounted to the user access compartment for rotation between a first position in which the security door closes the opening in the access compartment to prevent documents from being withdrawn therefrom and a second position in which the security door is contained within the user access compartment to allow the user to gain access to the compartment through the opening therein for removal of documents. The door assembly further includes structure for rotating the security door between the first and second positions. Structure is also provided for locking the security door in the first or closed position and for automatically opening the security door when a foreign object is encountered in the path of rotation of the security door.

28 Claims, 12 Drawing Figures

SECURITY DOOR ASSEMBLY FOR AN AUTOMATIC DOCUMENT DISPENSING DEVICE

FIELD OF THE INVENTION

This invention relates to automatic banking machines, and more particularly to a security door and receiving assembly for a user access compartment that conveys documents to the user through an opening in the user access compartment of an automatic document dispensing device.

THE PRIOR ART

Automatic banking machines have gained widespread acceptance by the banking community and the general public. This acceptance is partially based on the minimizing of the risk of unauthorized use of these machines through extensive checks on credit cards for activating such machines and also upon the ability of the automatic banking machine to make continuous self-checks of bad accounts. With the risk of unauthorized use now minimized, the banking industry and the general public have accepted automatic currency dispensers for unattended distribution of currency and related banking receipts to complete business and personal transactions. Further, the banking community and the general public are now accepting the use of automatic machines for transactions other than for cash withdrawals.

Typically, in the operation of an automatic currency dispenser, a coded credit card is inserted into the device, and the user enters certain data, such as authorization codes, quantity of cash desired and type of transaction upon a keyboard associated with the device. The device then processes the transaction, updates the user's account to reflect the current transaction, dispenses currency or a receipt if necessary and returns the coded credit card to the user as part of a routine operation.

In order to effectuate the step of dispensing currency or a banking receipt to the user, automatic currency dispensers utilize a drawer or secured area for receiving currency from the dispensing device and for subsequently delivering the currency to the user at a predetermined time in the dispensing cycle. Heretofore, drawer-like devices for delivering items such as currency and banking receipts to a customer such as those described and claimed in U.S. Pat. No. 3,784,090 issued to Michael H. Markham on Jan. 8, 1974, entitled "Safe Deposit Apparatus" and U.S. Pat. No. 3,957,173 issued to Melvin T. Roudebush on May 18, 1976, and entitled "User Access Compartment for an Automated Teller Machine" have been provided. However, these devices and others have proven to be lacking in sufficient size to accommodate large amounts of currency while providing the customer with sufficient access to easily obtain such currency and banking receipts after they have been dispensed. The use of larger user access compartments has further compounded the problem of maintaining security for the currency stored within the dispensing device and the user access compartment.

A need has thus arisen for a door and document receiving assembly for use with a user access compartment through which documents are dispensed to a user through an opening in the access compartment which both maintains the compartment secure and which provides for easy access to the dispensed currency or banking receipts. A need has further arisen for a door assembly for a user access compartment which is economical to manufacture, simple and safe in operation. To insure safe operation, such a door assembly if upon closing encounters a foreign object, such as a customer's hand, should automatically open to permit the object to be removed and prevent injury to the customer. Further, such an assembly should only permit the door to remain open a predetermined amount of time before closing after a dispensing cycle. In addition, a need has arisen for a door assembly for a user access compartment of a document dispensing device which is secure to prevent unauthorized entry into the dispensing device. Therefore, such a door assembly must provide for a lock mechanism to lock the door in a closed position.

SUMMARY OF THE INVENTION

In accordance with the present invention, a door and document receiving assembly is provided for a user access compartment in an automatic document dispensing device that permits easy access to the compartment while maintaining the compartment and the document dispensing device secure from unauthorized entry. The door assembly further includes safety features to prevent injury to the banking customer by automatically opening if encountering a hand of the user as the door closes.

In accordance with the present invention, a door assembly for a user access compartment through which documents are dispensed to the user through an opening in the user access compartment for use in an automatic document dispensing device includes a security door. The security door is pivotally mounted to the user access compartment for rotation between a first position in which the security door closes the opening to prevent documents from being withdrawn therefrom and a second position in which the security door is contained within the user access compartment to allow the user to gain access to the documents through the opening therein for removal. Structure is provided for rotating the security door between the first and second positions. Structure is also provided for locking the security door in the first position.

In accordance with another aspect of the present invention, a door assembly for a user access compartment for an automatic document dispensing device is provided and includes a mounting shaft extending through the user access compartment. A security door for opening in the user access compartment is pivotally mounted to the mounting shaft for rotation between a closed position for closing and locking the opening in the user access compartment to prevent documents from being withdrawn therefrom and an open position in which the security door is contained within the user access compartment for allowing the user to obtain documents from within the compartment through the opening therein. A drive motor is interconnected to the mounting shaft for rotating the security door between the closed and open positions. A door lever is pivotally mounted to the mounting shaft external of the user access compartment for transferring rotational motion from the drive motor to the security door. A drive cam is interconnected to the drive motor for engaging the door lever, such that upon actuation of the drive motor, the drive cam rotates to impart rotational motion to the door lever. A lock lever is pivotally mounted to the user access compartment for selectively engaging the door lever in the security door closed position for locking the security door to prevent user access to the compartment. The drive cam further includes a follower for disengaging the lock lever from the door lever upon actuation of the drive motor to permit the door lever to rotate and unlock the security door.

In accordance with yet another aspect of the present invention, a door and document receiving assembly for a user access compartment in an automatic document dispensing device includes a mounting shaft disposed within and extending through the user access compartment. A security door is provided for the compartment opening and is pivotally mounted to the mounting shaft for rotation between a closed position for closing and locking the user access compartment to prevent documents from being withdrawn therefrom and an open position in which the security door is contained within the user access compartment for allowing the user to obtain documents from within the compartment through the opening therein. A drive motor is provided for rotating the security door between the closed and open positions. A door lever is pivotally mounted to the mounting shaft external of the user access compartment for transferring rotational motion from the drive motor to the security door. A drive cam is interconnected to the drive motor for engaging the door lever, such that upon actuation of the drive motor, the drive cam rotates to impart rotational motion to the door lever. A lock lever is pivotally mounted to the user access compartment for selectively engaging the door lever in the security door closed position for locking the security door to prevent access to the compartment. The drive cam includes a cam follower for disengaging the lock lever from the door lever upon actuation of the drive motor to permit the door lever to rotate. The door and document receiving assembly further includes a first sensor cam interconnected to the drive cam for sensing the presence of a foreign object placed in the path of rotation of the security door rotating from the open position to the closed position. A first switch is mounted to the door lever, such that the first sensor cam continuously engages this first switch to deactivate the first switch as the security door rotates between the open and closed positions. The sensor cam disengages from the first switch to activate the first switch when the security door encounters the foreign object. The first switch generates a signal to the drive motor for reversing the direction of rotation of the drive motor and security door. The assembly further includes a second sensor cam interconnected to the drive cam for sensing the presence of a foreign object which prevents the security door from locking in the closed position. A second switch is mounted to the user compartment adjacent the door lever such that the second switch is actuated when the security door is in the first position. A third switch is provided and is mounted to the user access compartment adjacent the second sensor cam, such that the third switch is actuated when the security door is in the closed position. The security door is maintained in the closed position only if both the second and third switches are actuated by contact with the door lever and the second sensor cam to deactivate the drive motor. Actuation of the third switch without prior actuation of the second switch causes the drive motor to rotate the security door to the open position. The assembly further includes structure disposed within the user access compartment for receiving documents dispensed into the compartment and is movable between a document receiving position and a document dispensing position. The drive motor rotates the security door between the closed and open positions while simultaneously rotating the document receiving structure between the receiving and dispensing positions, such that when the security door is in the closed position the document receiving structure is in the receiving position and when the security door is in the open position the document receiving structure is in the dispensing position.

DESCRIPTION OF THE DRAWINGS

A more complete understanding of the invention and its advantages will be apparent from the following detailed description taken in conjunction with the accompanying drawings in which.

DESCRIPTION OF THE PREFERRED EMBODIMENT

Figure 1:
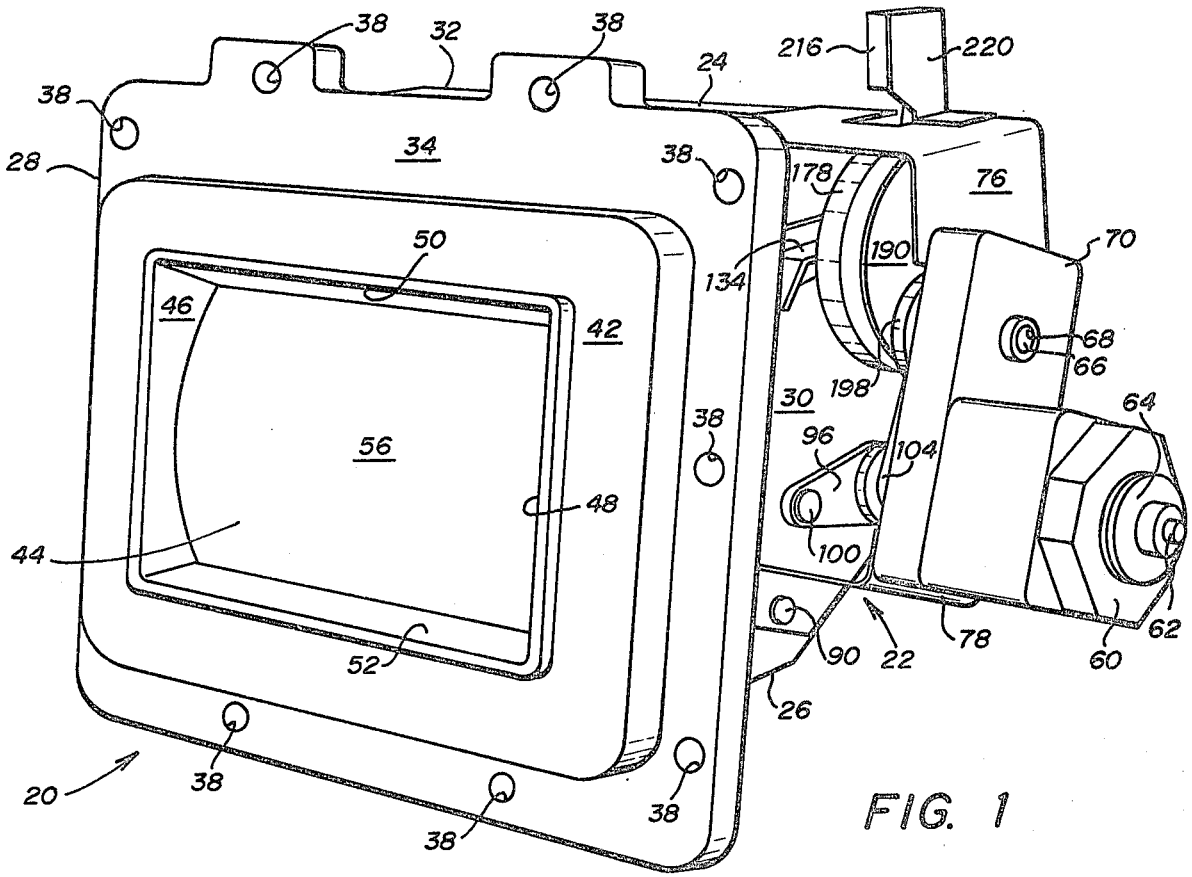
FIG. 1 is a perspective view of a user access compartment for an automatic document dispensing device including the security door assembly of the present invention illustrated in the closed and locked position.

FIG. 1 illustrates a user access compartment generally identified by the numeral 20 and the security door assembly of the present invention, generally identified by the numeral 22. User access compartment 20 includes top and bottom walls 24 and 26, side walls 28 and 30 and rear and front walls 32 and 34. Front wall 34 of user access compartment 20 includes a plurality of mounting apertures 38 for receiving bolts or the like (not shown) for mounting user access compartment 20 to a wall of a bank or to supporting structure of an automatic document dispenser.

Mounted to front wall 34 of user access compartment 20 is a fascia 42 which defines an access opening 44 to user access compartment 20. Access opening 44 is defined by fascia 42 having side walls 46 and 48, and top and bottom walls 50 and 52. A security door 56, illustrated in the closed position in FIG. 1, closes access opening 44 of user access compartment 20. Security door 56 is rotatable to an open position to allow a user to gain access through access opening 44 to documents contained within user access compartment 20. The operation of security door assembly 22 to effectuate the rotation of security door 56 from the closed position illustrated in FIG. 1 to the open position illustrated in FIG. 8 will subsequently be described in connection with FIGS. 4–10.

The walls of user access compartment 20 and security door 56 are constructed of sufficiently thick steel to satisfy security requirements dictated by the banking industry. Security door 56 is further dimensioned to closely fit the access opening 44 when security door 56 is in the closed position to prevent foreign objects from being inserted between security door 56 and fascia walls 46, 48, 50 and 52. User access compartment 20 functions to convey to a customer of an automatic banking machine currency and/or banking receipts from a conventional automatic document dispenser. Such a document dispenser is described and claimed in the copending patent application of Richard C. Hickey, entitled "Document Dispenser with Escrow System" filed Feb. 4, 1977, Ser. No. 765,827, U.S. Pat. No. 3,685,690 to Karecki et al. issued Aug. 22, 1972 and entitled "Credit Card Automatic Currency Dispenser" and U.S. Pat. No. 3,761,682 to Barnes et al. issued Sept. 25, 1973 and entitled "Credit Card Automatic Currency Dispenser." As used herein, the term "documents" will refer to both currency and banking receipts and any other material typically dispensed to a user of an automatic banking machine.

Figure 2:
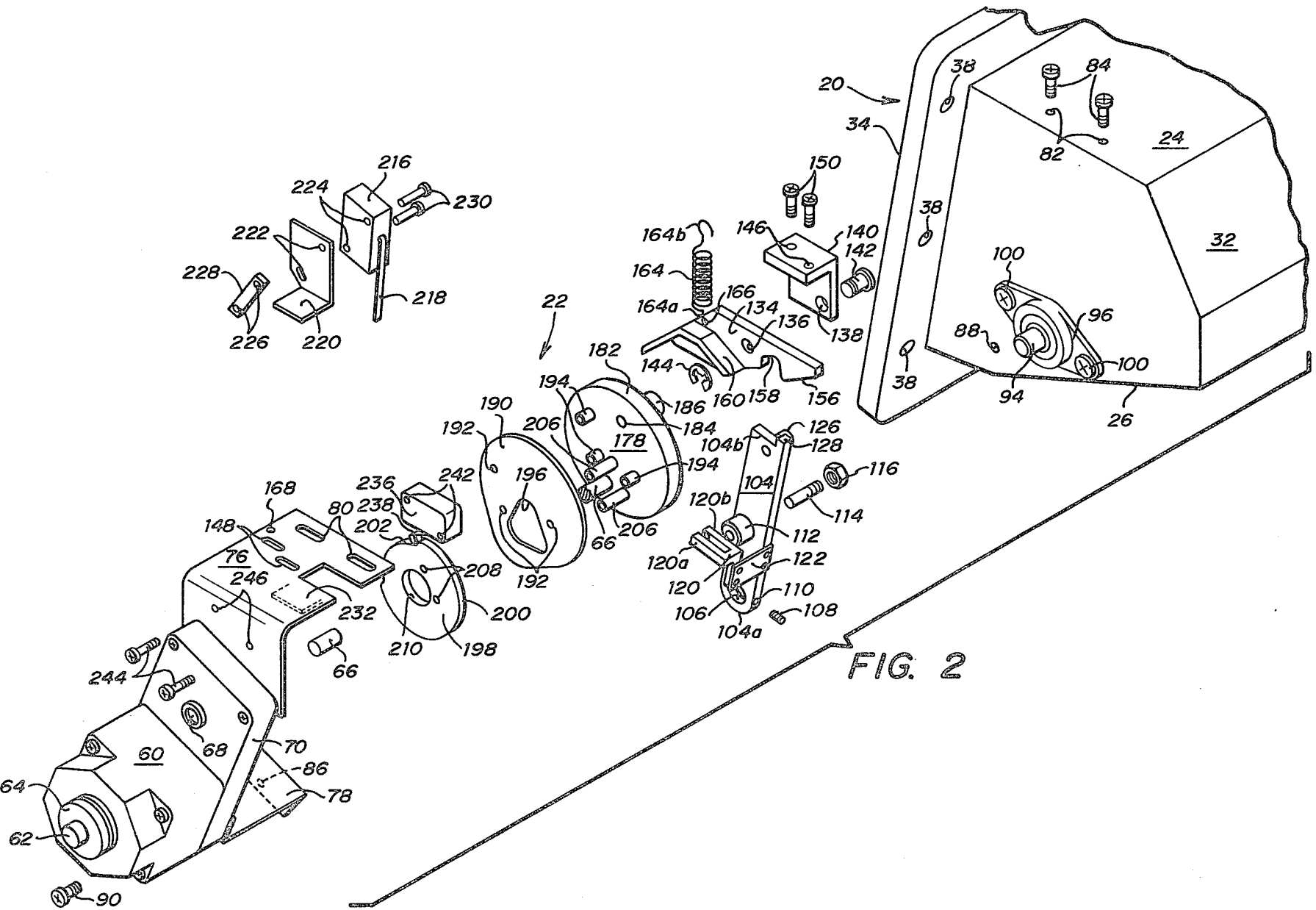
FIG. 2 is an exploded perspective view of the security door assembly of the present invention including a side wall of the user access compartment.
Figure 3:
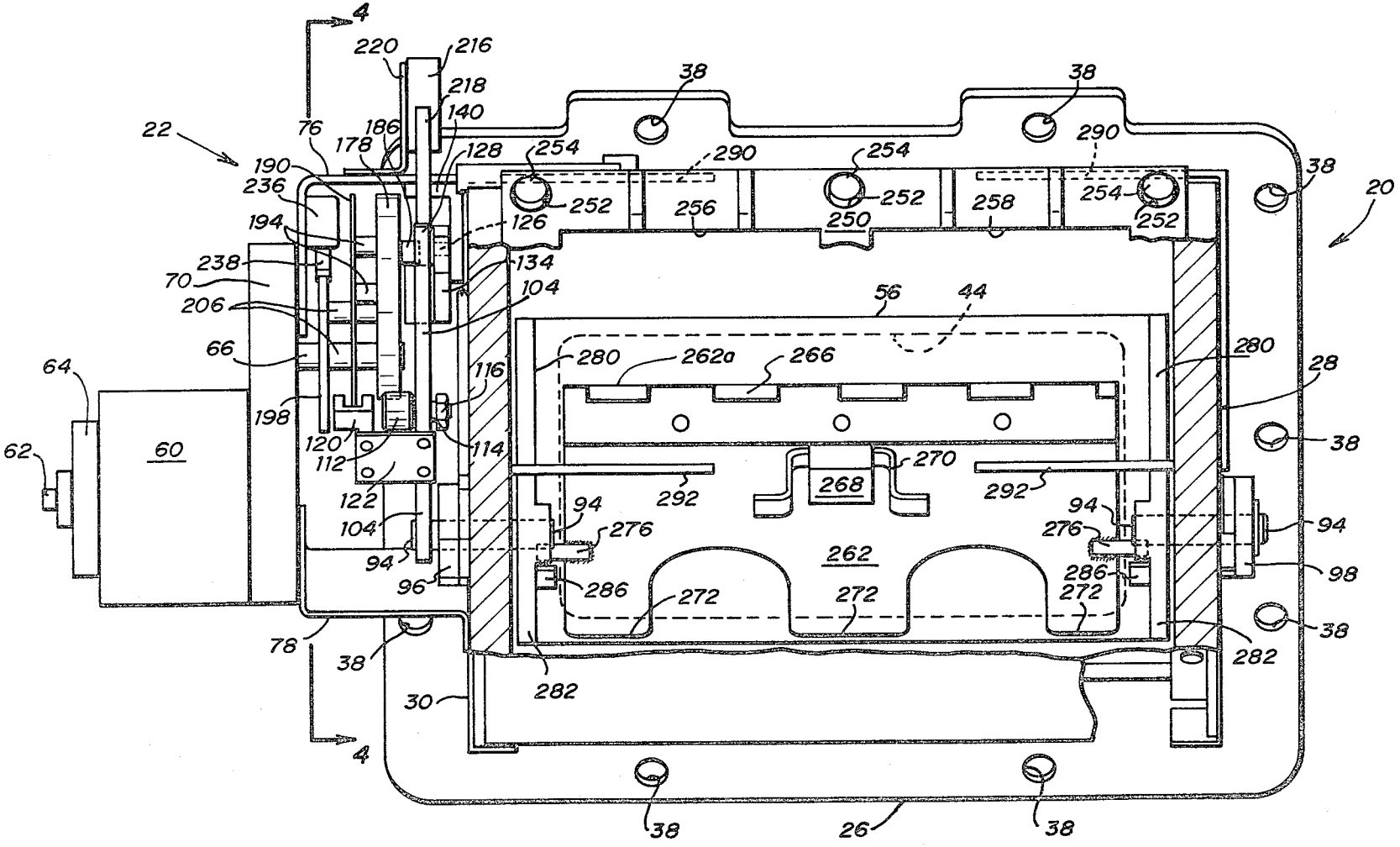
FIG. 3 is a rear elevational view of the user access compartment and security door assembly shown in FIG. 1.

Referring simultaneously to FIGS. 1, 2 and 3, wherein like numerals are utilized for like and corresponding components, the components of security door assembly 22 will now be described. Security door 22 includes a drive motor 60, which in the preferred embodiment generates approximately twenty-two revolutions per minute. Drive motor 60 includes a drive shaft 62 and a brake arrangement 64. Rotational motion from drive shaft 62 is transferred to a drive cam shaft 66 mounted in an aperture 68 of a gearing device 70 mounted to drive motor 60.

Gearing device 70 and drive motor 60 are mounted to top wall 24 and side wall 30 of user access compartment 20 using an upper motor mounting bracket 76 and a lower motor mounting bracket 78. Apertures 80 contained within upper motor mounting bracket 76 align with apertures 82 contained within top wall 24 of user access compartment 20. Screws 84 mount upper motor mounting bracket 76 to top wall 24. An aperture 86 contained in lower motor mounting bracket 78 aligns with an aperture 88 contained within side wall 30 for receiving a screw 90 for mounting lower motor mounting bracket 78 to side wall 30 of user access compartment 20.

Mounted to side wall 30 and side wall 28 (FIG. 3) of user access compartment 20 is a security door shaft 94, which mounts security door 56 to user access compartment 20. Security door shaft 94 extends through user access compartment 20 and is journaled to side walls 28 and 30 using shaft mounting brackets 96 and 98. Shaft mounting brackets 96 and 98 are interconnected to side walls 28 and 30 using screws 100.

Mounted to security door shaft 94 is a door open lever 104. Door open lever 104 is interconnected to door shaft 94 through an aperture 106 located at lower end **104*a* of door open lever 104 using a set screw 108 inserted into an aperture 110 for engaging door shaft 94. Mounted to door open lever 104 is a door open lever cam follower 112 including a shaft 114 and nut 116. The operation of door open lever cam follower 112 will subsequently be described. Also mounted to door open lever 104 is door lever contact sensor switch 120 using a mounting bracket 122. Door lever contact sensor switch 120 includes contact arms 120*a* and 120*b* and is an optically actuated switch. Mounted to upper end 104*b* of door open lever 104 is a lock pin 126. Upper end 104*b* of door open lever 104 also includes an extension finger 128**, whose operation will also subsequently be described.

Security door assembly 22 further includes a door lock lever 134. Door lock lever 134 includes an aperture 136 which aligns with an aperture 138 contained within a door lock lever mounting bracket 140. Door lock lever 134 is pivotally affixed to door lock lever mounting bracket 140 using a brazed pin 142 and an E-ring 144. Door lock lever mounting bracket 140 includes apertures 146 which align with apertures 148 contained within upper motor mounting bracket 76 for mounting door lock lever mounting bracket 140 to upper motor mounting bracket 176 using screws 150.

Door lock lever 134 includes a camming surface 156 which engages lock pin 126 of door open lever 104. Door lock lever 134 further includes a cutout 158 which engages lock pin 126 of door open lever 104 when security door 56 is in the closed and locked position, as will subsequently be described. Door lock lever 134 further includes a ramp camming surface 160. Door lock lever 134 is maintained in a horizontal position using a biasing spring 164. Lower end **164*a* of spring 164 is received by an aperture 166 contained within door lock lever 134. Upper end 164*b* of spring 164 is received by an aperture 168 contained within upper motor mounting bracket 76**.

Drive cam shaft 66 is mounted to a drive cam 178 through an aperture 180 in drive cam 178. Drive cam 178 includes a camming surface 182 which engages door open lever cam follower 112 interconnected to door open lever 104. Mounted to drive cam 178 through an aperture 184 using a brazed pin (not shown) is a door lock lever cam follower 186. Door lock lever cam follower 186 engages ramp camming surface 160 of door lock lever 134.

Interconnected to drive cam 178 is a door lever contact sensor cam 190. Door lever contact sensor cam 190 is disposed such that it is positioned between contact arms 120*a* and 120*b* of door lever contact sensor switch 120 to break the optical contact between arms 120*a* and 120*b*. Door lever contact sensor cam 190 includes apertures 192 for mounting to spacers 194 of drive cam 178 using screws (not shown). It therefore can be seen that door lever contact sensor cam 190 rotates with and at the same speed as drive cam 178 under the control of drive cam shaft 66 driven by drive motor 60. Door lever contact sensor cam 190 further includes an aperture 196 through which drive cam shaft 66 passes.

Security door assembly 22 further includes a motor contact sensor cam 198 having a camming surface 200 and a camming surface 202. Motor contact sensor cam 198 is interconnected to drive cam 178 using mounting spacers 206 of drive cam 178. Mounting spacers 206 pass through aperture 196 of door lever contact sensor cam 190 to align with apertures 208 contained within motor contact sensor cam 198. Drive cam shaft 66 passes through an aperture 210 contained within motor contact sensor cam 198. It therefore can be seen that motor contact sensor cam 198 also rotates with and at the same speed as drive cam 178.

Security door assembly 22 further includes a door lock switch 216 having a normally open switch arm 218. Switch arm 218 engages extension finger 128 of door open lever 104 to actuate door lock switch 216. Door lock switch 216 is mounted to a bracket 220 having apertures 222. Apertures 222 align with apertures 224 contained within door lock switch 216 and apertures 226 in a switch plate 228. Screws 230 pass through apertures 224, 222 and 226 to affix door lock switch 216 to bracket 220. Bracket 220 is in turn mounted to upper motor mounting bracket 76 in the area indicated by the numeral 232.

Security door assembly 22 further includes a motor contact switch 236 having a switch arm roller 238 which engages camming surfaces 200 and 202 of motor contact sensor cam 198. Motor contact switch 236 is normally open and is actuated by the contact made between switch arm roller 238 and camming surface 200 of motor contact sensor cam 198. Motor contact switch 236 includes apertures 242 for receiving screws 244 through apertures 246 contained within upper motor mounting bracket 76 to mount motor contact switch 236 to upper motor mounting bracket 76.

Referring to FIG. 3, mounted to rear wall 32 of user access compartment 20 is a document entry plate 250 having apertures 252 for receiving screws 254. Centrally disposed within document entry plate 250 are elongated slotted apertures 256 and 258, which receive dispensed currency and/or banking receipts from the dispensing device of the automatic banking machine for transfer into user access compartment 20.

Figure 4:
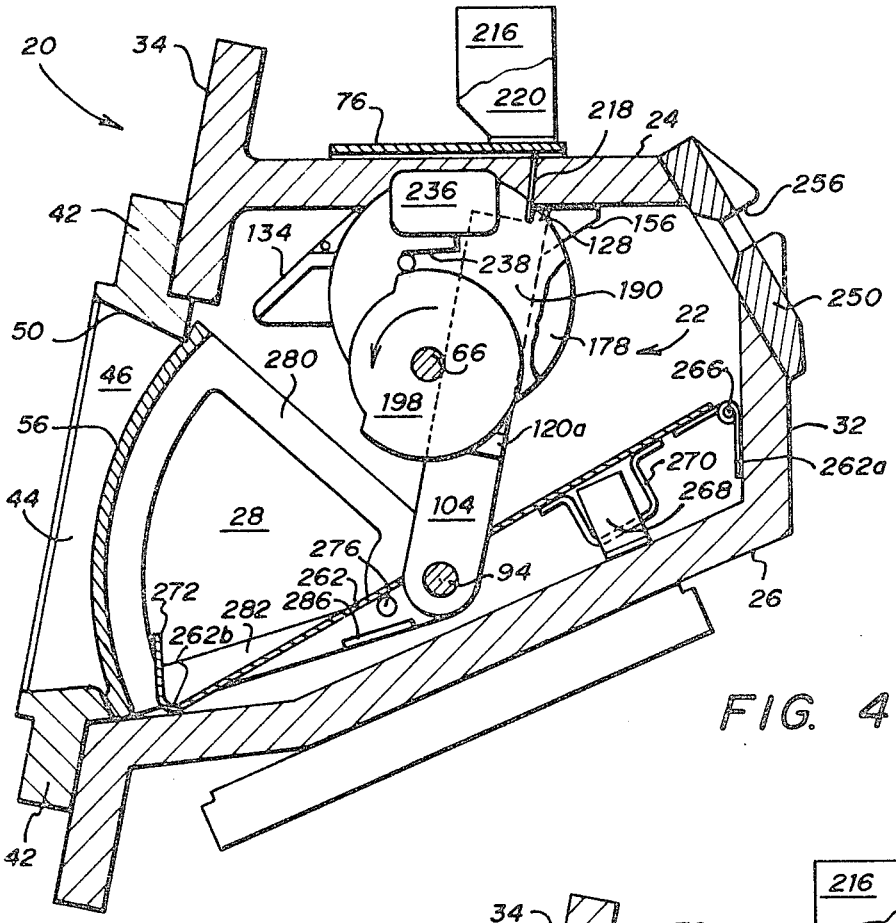
FIG. 4 is a sectional view taken generally along sectional lines 4—4 of FIG. 3 illustrating the security door assembly in the closed and locked position.

Referring simultaneously to FIGS. 3 and 4, contained within user access compartment 20 is a document dispensing tray 262 for receiving dispensed documents which have been dispensed into user access compartment 20 through elongated slotted apertures 256 and 258. Document dispensing tray 262 is hinged near end 262*a* to the interior surface of rear wall 32 of user access compartment 20 using a hinge 266. Hinge 266 extends along the total length of document dispensing tray 262 along the interior surface of rear wall 32. Document dispensing tray 262 is mounted to bottom wall 26 of user access compartment 20 using a mounting bracket 268 through which a U-shaped member 270 passes to attach document dispensing tray 262 to mounting bracket 268. End 262*b* of document dispensing tray 262 includes an L-shaped portion 272 for retaining documents dispensed onto document dispensing tray 262. Centrally disposed on the bottom side of document dispensing tray 262 and adjacent side walls 28 and 30 of user access compartment 20 are document dispensing tray lifting pins 276. Tray lifting pins 276 interact with security door 56 to raise document dispensing tray 262 as security door 56 moves from the closed position to the open position as will subsequently be described.

Security door 56 includes an upper arm member 280 and a lower arm member 282 through which security door 56 is pivotally mounted to door shaft 94. Mounted to the bottom surface of lower arm 282 adjacent side walls 28 and 30 of user access compartment 20 are tray lifting cam surfaces 286, which engage lifting pins 276 as security door 56 rotates from the closed position to the open position as will subsequently be described.

Associated with each aperture 256 and 258 are optical sensors 290 and 292 which detect the presence of a document within user access compartment 20 to control the actuation of drive motor 60. The presence of a document causes an optical beam between sensors 290 and 292 to be broken, thereby generating a signal to drive motor 60 indicating a document has been dispensed. Similarly, the reestablishment of the optical beam between sensors 290 and 292 indicates that the customer has withdrawn a document from user access compartment 20.

Referring sequentially to FIGS. 4–10, the operation of the present door and document receiving assembly will be described. For clarity of illustration in these figures, side wall 30 of user access compartment 20 and side wall 48 of fascia 42 have been removed. In addition, to clearly illustrate a specific step in the operation of the security door in rotating from the closed position to the open position and back to the closed position various components have been omitted for clarity of illustration from one figure to the next. Like numerals are utilized for like and corresponding components throughout the figures.

Referring initially to FIG. 4, security door 56 is illustrated in the closed and locked position, such that security door 56 closes access opening 44 within front wall 34 of user access compartment 20. FIG. 4 also illustrates the document receiving position of document dispensing tray 262. In this position, document dispensing tray 262 is in its lowermost position within user access compartment 20. Lifting pins 276 do not contact tray lifting camming surfaces 286 in this first position. Door lock switch 216 is closed and actuated due to the contact of extension finger 128 of door open lever 104 with door lock switch arm 218. Motor contact switch 236 is also closed and actuated due to the contact between switch arm roller 238 and camming surface 200 of motor contact sensor cam 198. In the position illustrated in FIG. 4, drive motor 60 (FIG. 3) is deactivated and the access compartment is ready for receipt of documents from the dispensing device associated with the automatic banking machine. It is only when both motor contact switch 236 and door lock switch 216 are closed, indicating that security door 56 is in the closed and locked position, that documents will be dispensed into user access compartment 20.

Typically in the operation of an automatic banking machine, after the customer has completed his transaction the dispensing device associated with the automatic banking machine will dispense currency or a banking receipt for delivery to the customer. The dispensing cycle of the banking machine is complete after the documents have been dispensed into user access compartment 20. Documents entering elongated slotted apertures 256 and 258 from the dispensing device of the automatic banking machine break the optical beam between optical sensors 290 and 292 associated with slotted apertures 256 and 258 to generate a signal which indicates that the documents have been successfully disposed into user access compartment 20. This signal is applied to a controlling computer, which after completion of the dispensing of all documents of the particular transaction, generates a signal to drive motor 60 to actuate drive motor 60.

Figure 5:
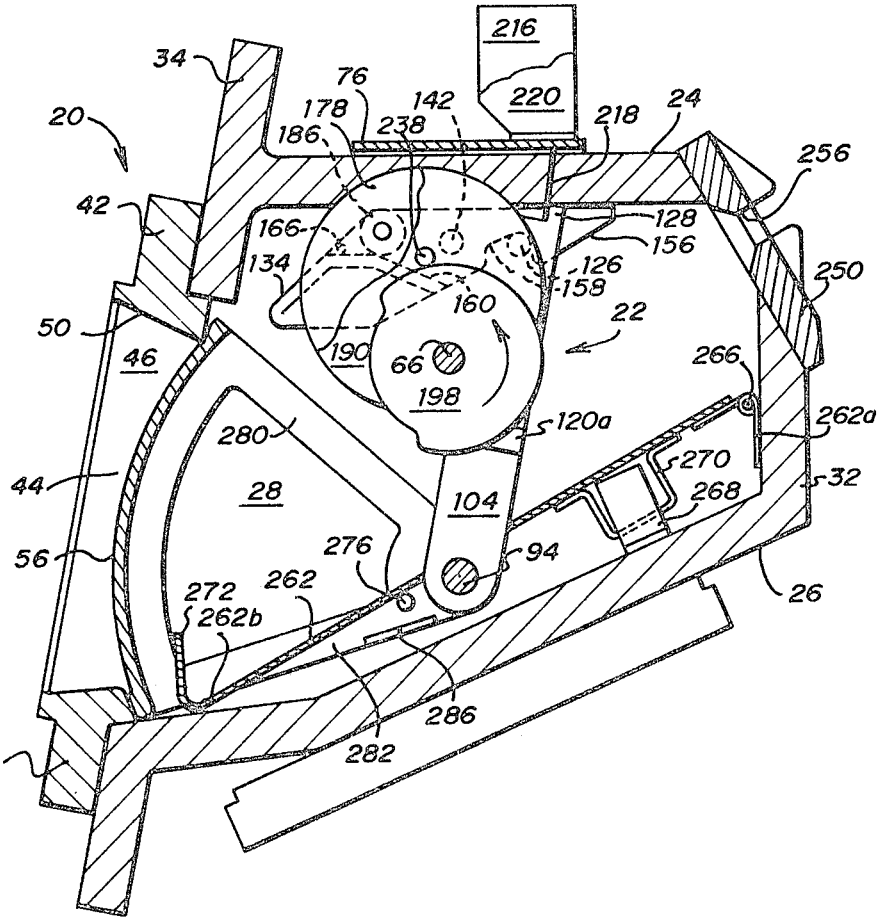
FIG. 5 is a sectional view similar to FIG. 4 illustrating the security door assembly immediately after actuation of the drive motor and prior to unlocking, in which the door lock lever cam follower has engaged the door lock lever.

Referring to FIG. 5, the position of the components of security door assembly 22 and document dispensing tray 262 is illustrated shortly after drive motor 60 is actuated. It can be seen that lock pin 126 of door open lever 104 engages cutout 158 of door lock lever 134, such that security door 56 is still in the locked position. Door lock lever cam follower 186 has initially engaged the horizontal portion of ramp camming surface 160 of door lock lever 134. Motor contact switch arm roller 238 of motor contact switch 236 engages camming surface 200 of motor contact sensor cam 198. Security door 56 and document dispensing tray 262 remain in the position as illustrated in FIG. 4.

Figure 6:
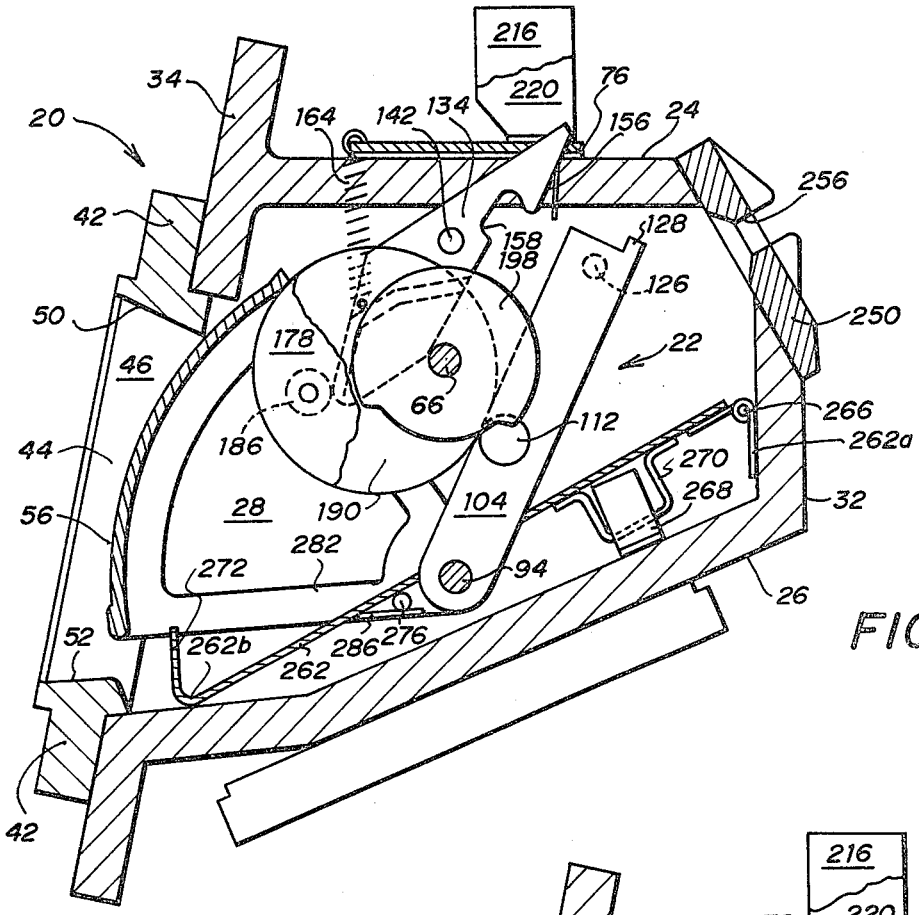
FIG. 6 is a sectional view similar to FIG. 4 illustrating the security door assembly in the door unlocked position, in which the door lock lever has disengaged from the door open lever, the security door has begun to open and the document tray has engaged the door mounting frame.

Referring to FIG. 6, as a result of rotation of drive motor 60 rotating drive cam shaft 66, drive cam 178 has rotated such that security door 56 is now unlocked and has begun to rotate to the open position. Rotation of drive cam 178 has caused door lock lever cam follower 186 to move from the horizontal portion of ramp camming surface 160 of door lock lever 134 to the inclined portion of ramp camming surface 160. This motion has caused door lock lever 134 to rotate counterclockwise upwardly about pin 142 as shown in FIG. 6. The counterclockwise rotation of door lock lever 134 has caused lock pin 126 of door open lever 104 to disengage from cutout 158 of door lock lever 134. Since now disengaged from door lock lever 134, door open lever 104 is free to rotate in a clockwise direction about door shaft 94. The rotation of door open lever 104 is effected by the engagement of camming surface 182 of drive cam 178 with door open lever cam follower 112 mounted to door open lever 104. The clockwise rotation of door open lever 104 simultaneously causes security door 56 to rotate in a clockwise direction. The initial rotation of security door 56 as shown in FIG. 6 has caused dispensing tray lifting camming surfaces 286 to engage tray lifting pins 276.

Figure 7:
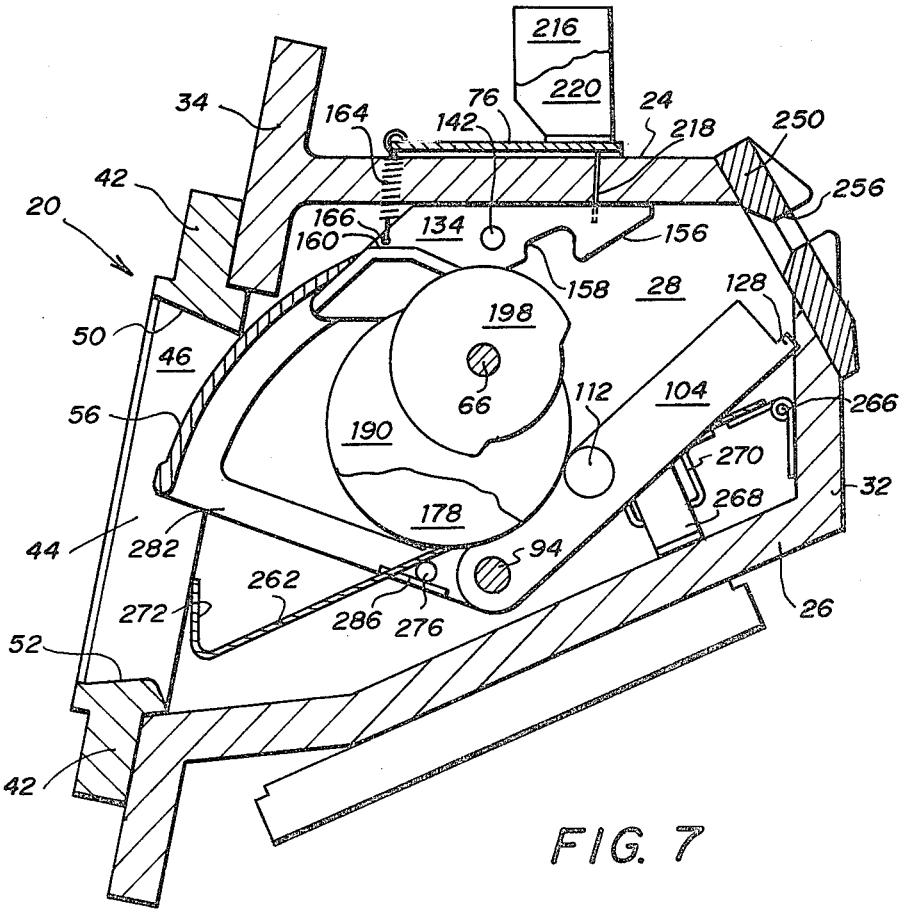
FIG. 7 is a sectional view similar to FIG. 4 illustrating the security door assembly in which the security door is positioned midway between the door closed and open positions and in which the document tray has begun to rise.

Referring now to FIG. 7, security door 56 has now moved to a position midway between the closed and open positions as a result of the continued rotation of drive cam 178 controlled by drive motor 60 through drive cam shaft 66. Door lock lever cam follower 186 has disengaged from ramp camming surface 160 of door lock lever 134, such that door lock lever 134 under the influence of biasing spring 164 has returned to a horizontal position similar to the position illustrated in FIG. 4. The continued rotation of drive cam 178 engaging door open lever cam follower 112 of door open lever 104 has caused door open lever 104 to further rotate in a clockwise direction about door shaft 94, and accordingly security door 56 has further rotated in a clockwise direction about door shaft 94 to the position illustrated in FIG. 7.

FIG. 7 also illustrates the position of dispensing tray lifting camming surfaces 286 as having engaged dispensing tray lifting pins 276 to effect a clockwise rotation of document dispensing tray 262 about hinge 266. The raising of document dispensing tray 266 has caused U-shaped mounting member 270 to upwardly raise within mounting bracket 268 of document dispensing tray 262. U-shaped mounting member 270 functions as a lock to present banging or jamming of document dispensing tray 262 by the use of the automatic document dispensing device.

Figure 8:
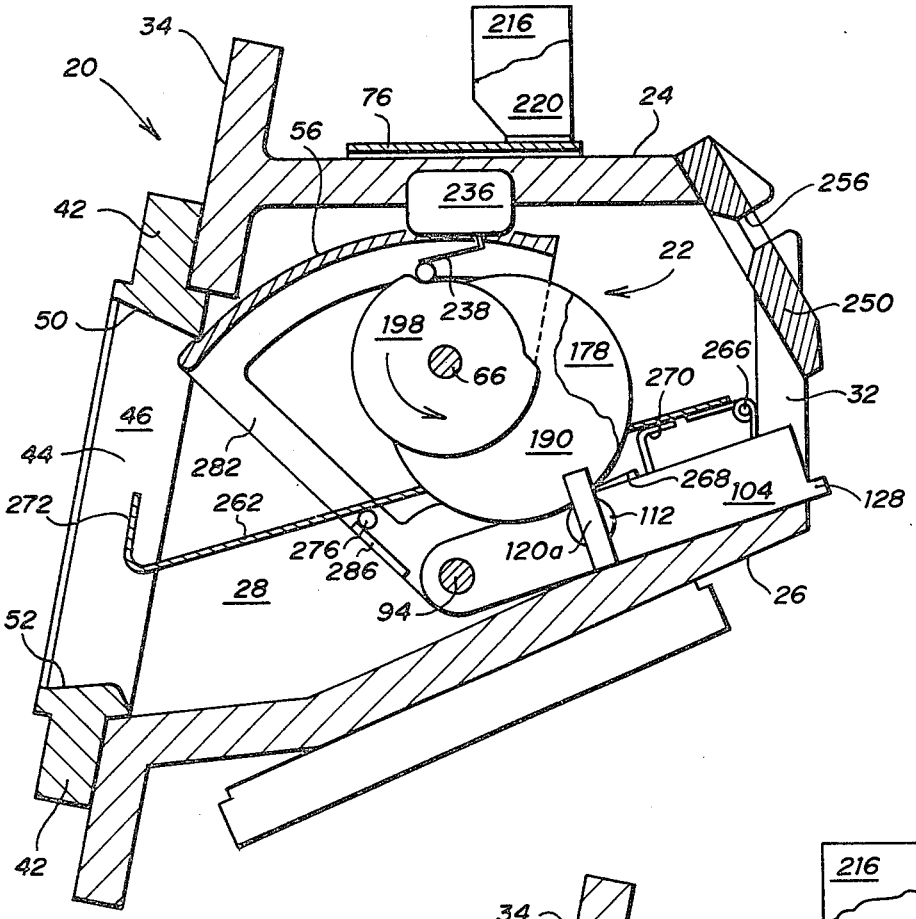
FIG. 8 is a sectional view similar to FIG. 4 illustrating the security door assembly in which the security door is in the open position and the document tray is in the dispensing position.

Referring to FIG. 8, security door 56 is illustrated in the open position and document dispensing tray 262 is illustrated in the dispensing position. Drive cam 178 acting against door open lever cam follower 112 of door open lever 104 has caused door open lever 104 to rotate in the clockwise direction to its full extent about door shaft 94 and therefore, security door 56 has rotated in the clockwise direction about door shaft 94 to its open position. Simultaneously with the opening of security door 56, the interaction between dispensing tray lifting camming surfaces 286 and tray lifting pins 276 has raised document dispensing tray 262 to its dispensing position as illustrated in FIG. 8. Door lock lever 134 (not shown) remains in the same position as illustrated in FIG. 7.

FIG. 8 also illustrates the position of motor contact switch arm roller 238 of motor control switch 236 in the open position of security door 56. Motor control switch arm roller 238 now for the first time engages camming surface 202 of motor contact sensor cam 198 to open motor contact switch 236. The opening or deactivation of motor contact switch 236 generates a signal to drive motor 60 to deactivate drive motor 60, such that security door 56 remains in the open position as illustrated in FIG. 8 for a predetermined elapsed time interval. After the maximum amount of time has elapsed under the control of the controlling computer, drive motor 60 is again actuated to return security door 56 to the closed and locked position. Actuation of drive motor 60 may also be accomplished, prior to the elapse of the total predetermined time interval by the user withdrawing dispensed documents from user access compartment 20. The withdrawal of documents from document dispensing tray 262 again completes the optical beam between sensors 290 and 292 as the documents no longer break the sensor path between sensors 290 and 292. The completion of the optical beam also initiates a signal from the controlling computer to drive motor 60 to begin actuation of drive motor 60. Actuation of drive motor 60 causes rotation of drive cam shaft 66 and drive cam 178 to begin closing security door 56 to the closed and locked position as illustrated in FIG. 4.

Referring to FIG. 9, drive motor 60 has again been actuated and security door 56 is illustrated in the nearly closed position. Security door 56 under the influence of gravity has rotated from the position shown in FIG. 8 to the position shown in FIG. 9. The counterclockwise rotation of security door 56 about door shaft 94 has caused door open lever 104 to rotate in a counterclockwise direction about door shaft 94. Door open lever 104 has now rotated from the position shown in FIG. 8 to the position shown in FIG. 9, such that lock pin 126 of door open lever 104 now engages camming surface 156 of door lock lever 134. This engagement causes door lock lever 134 to rotate in a counterclockwise direction about pin 142 to the position of security door assembly 22 as illustrated in FIG. 10.

Figure 9:
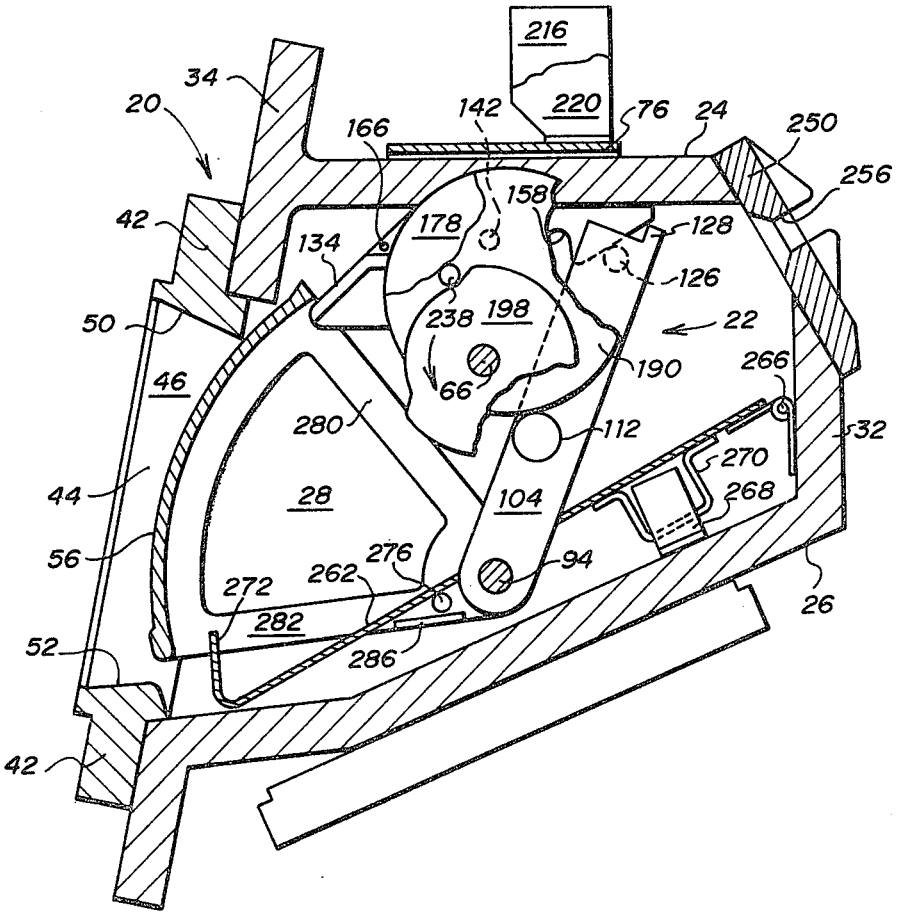
FIG. 9 is a sectional view similar to FIG. 4 illustrating the security door assembly in which the door open lever lock pin has engaged the door lock lever camming surface prior to the closing of the security door.

Document dispensing tray 262 illustrated in FIG. 9 has returned to the document receiving position corresponding to that position illustrated in FIG. 4. FIG. 9 also illustrates the position of motor contact switch arm roller 238 as continuing to contact camming surface 202 of motor contact sensor cam 198 which has rotated from the position illustrated in FIG. 8 to the position illustrated in FIG. 9.

Figure 10:
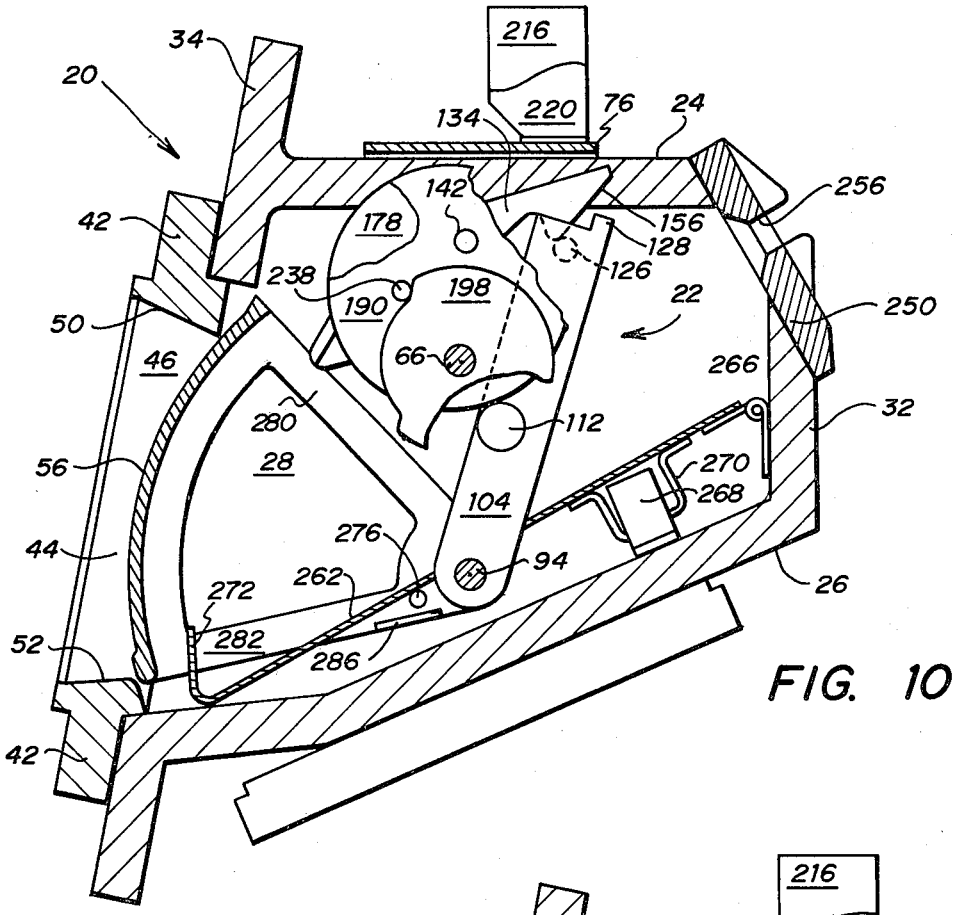
FIG. 10 is a sectional view similar to FIG. 4 illustrating the security door assembly in which the door open lever lock pin has raised the door lock lever just prior to engaging the door lock lever to lock the security door.

FIG. 10 illustrates the position of the security door assembly 22 immediately prior to security door 56 achieving the closed and locked position as illustrated in FIG. 4. Door lock lever 134 has rotated in a counterclockwise direction due to the engagement of lock pin 126 of door open lever 104 with camming surface 156 of door lock lever 134. Door open lever 104 continues to rotate in a counterclockwise direction about door shaft 94 due to the closing of security door 56 until lock pin 126 of door open lever 104 engages cutout 158 of door lock lever 134. Once lock pin 126 has engaged cutout 158 of door lock lever 134 the components of security door assembly 22 are again configured as illustrated in FIG. 4. As door open lever 104 rotates from the position illustrated in FIG. 10 to the position illustrated in FIG. 4, extension finger 128 of door open lever 104 engages door lock switch arm 218 of door lock switch 216 to close door lock switch 216.

Drive cam 178 and motor contact sensor cam 198 continue to rotate as drive cam shaft 66 rotates, such that motor contact switch arm roller 238 of motor contact switch 236 again contacts camming surface 200 of motor contact sensor cam 198 as shown in FIG. 4. This resulting contact closes motor contact switch 236 to generate a signal to drive motor 60 to deactivate drive motor 60. It is only after door lock switch 216 has been closed that the subsequent contact between motor contact switch arm roller 238 and camming surface 200 of motor contact sensor cam 198 causes drive motor 60 to be deactivated to complete the rotation cycle of security door 56 between the closed and locked position, open position and again closed and locked position. An important aspect of the present invention is that drive motor 60 is deactivated only if door lock switch 216 has been closed prior to the closure of motor contact switch 236. This sequence of switch closures is disrupted, however, when a thin foreign object interferes with the closure of security door 56 to prevent security door 56 from locking as will be described in connection with FIG. 12.

Figure 11:
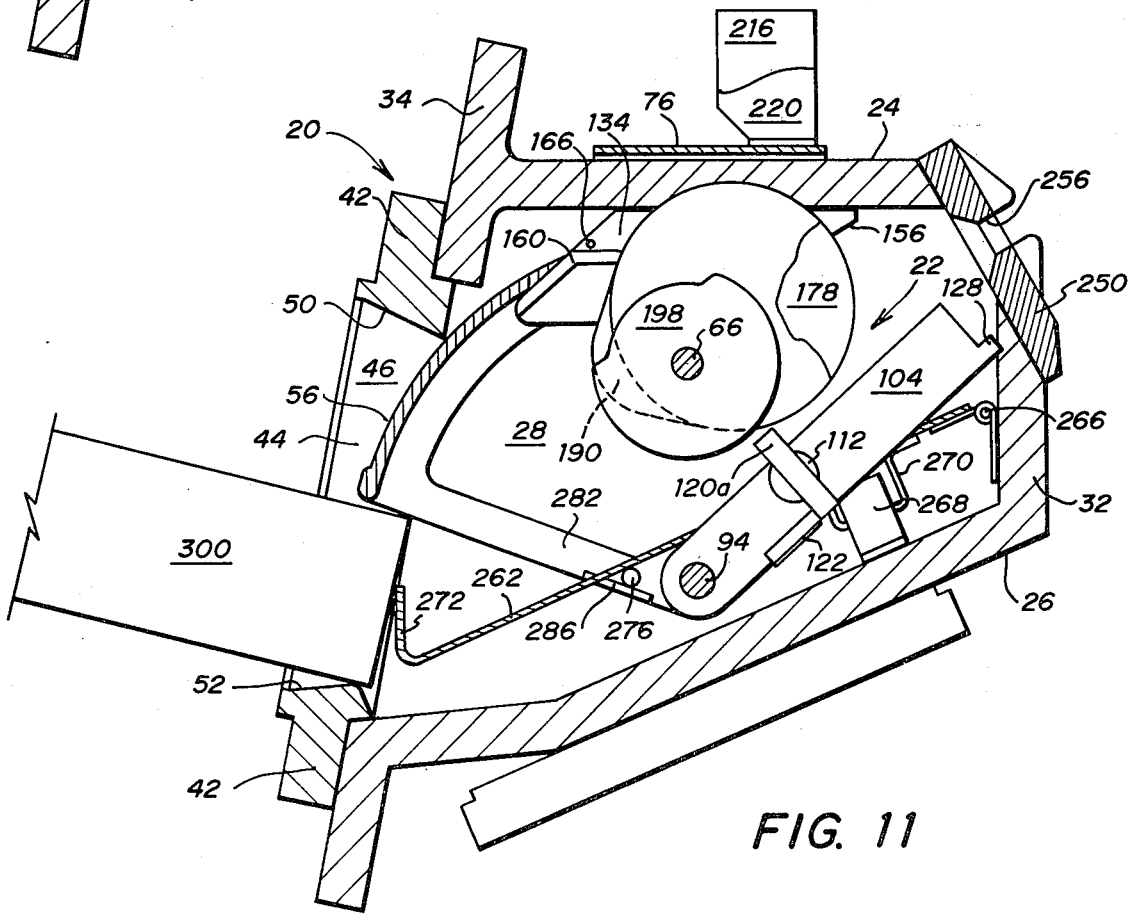
FIG. 11 is a sectional view similar to FIG. 4 illustrating the security door assembly in which a foreign object has been inserted into the path of rotation of the security door as the door rotates from the open to the closed position.

FIG. 11 illustrates the positioning and operation of the present security door assembly 22 when a foreign object such as the user's hand or a bar 300 has been inserted into the path of security door 56 as it rotates from the position illustrated in FIG. 8 to the position illustrated in FIG. 9. In previous discussions with respect to FIGS. 4–10 it will be noted that door lever contact sensor cam 190 being interconnected to drive cam 178 rotates with drive cam 178. During normal operation, door lever contact sensor cam 190 is disposed between contact arms 120*a* and 120*b* of door lever contact sensor switch 120 to break the optical beam between arms 120*a* and 120*b* thereby deactivating door lever contact sensor switch 120. Because door open lever cam follower 112 is continuously engaged with camming surface 182 of drive cam 178, door lever contact sensor cam 190 is always disposed between arms 120*a* and 120*b* of door lever contact sensor switch 120. However, when a foreign object, such as object 300, interferes with the path of security door 56, door lever contact sensor cam 190 disengages from its position between arms 120*a* and 120*b* of door lever contact sensor switch 120 as illustrated in FIG. 11.

Because security door 56 is barred from rotating to the closed position due to the presence of foreign object 300, door open lever 104 is prevented from continued rotation in the counterclockwise direction about door shaft 94 as would be the normal sequence of operation. Even though security door 56 is prevented from rotating, drive cam shaft 66 continues to rotate under the control of drive motor 60. Rotation of cam drive shaft 66 causes drive cam 178 to continue to rotate in a counterclockwise direction, which in turn rotates door lever contact sensor cam 190 in a counterclockwise direction such that door lever contact sensor cam 190 now disengages from between arms 120*a* and 120*b* of door lever contact sensor switch 120. This disengagement causes door lever contact sensor switch 120 to close, thereby generating a signal to drive motor 60. Drive motor 60 then reverses its direction of rotation, such that camming surface 182 of drive cam 178 will engage door open lever cam follower 112 of door open lever 104 to cause security door 56 to return to the open position as illustrated in FIG. 8. As a result, the foreign object 300 can be removed, and if the object was the user's hand, the hand will not be trapped by security door 56 attempting to close as it rotates from the position illustrated in FIG. 8 to the position illustrated in FIG. 4. After encountering a foreign object 300, security door 56 will rotate to the position illustrated in FIG. 8, will remain open for a predetermined elapsed time interval and then attempt to reclose according to the sequence of steps previously described. This sequence will continue to repeat until the foreign object 300 has been removed from the path of the closing security door 56.

Figure 12:
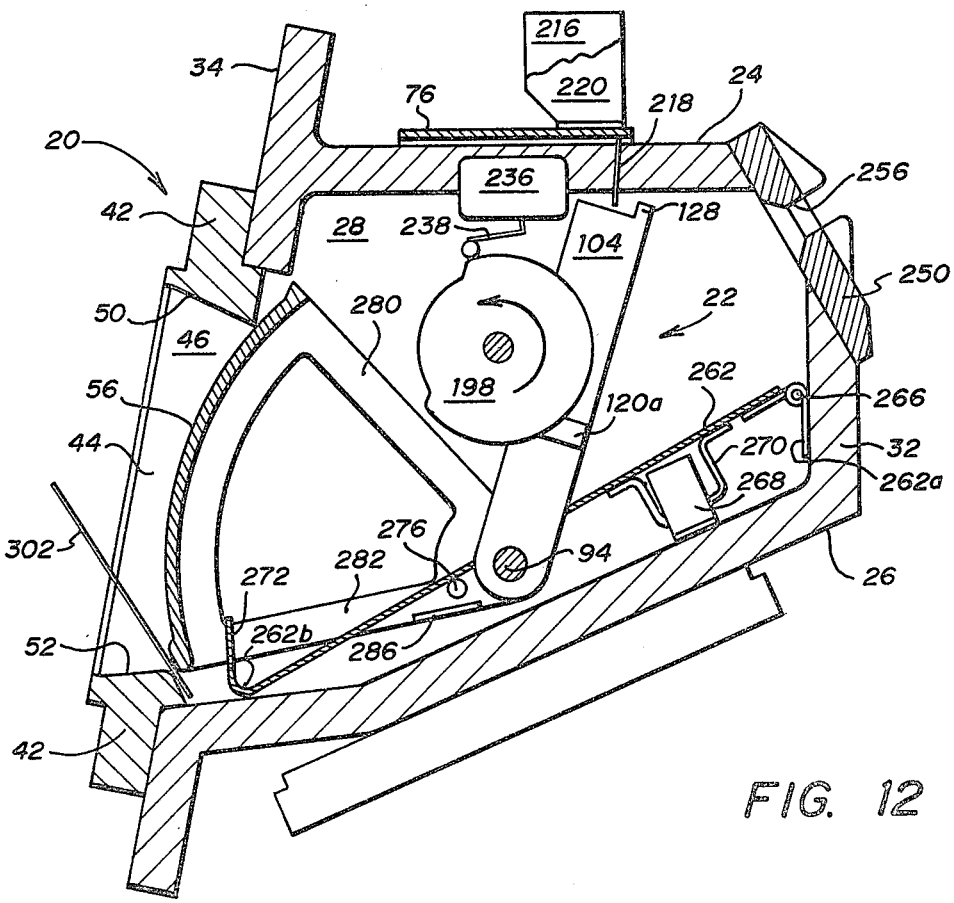
FIG. 12 is a sectional view illustrating the security door assembly in which a foreign object has been inserted into the path of rotation of the security door which prevents the door from achieving the locked position as illustrated in FIG. 4.

Referring to FIG. 12, a thin foreign object 302 has been inserted into the path of rotation of security door 56 thereby preventing security door assembly 22 from assuming the closed and locked position as illustrated in FIG. 4. Although motor contact switch arm roller 236 has engaged camming surface 200 of motor contact sensor cam 198 to close motor contact switch 236, it can be seen that door lock switch arm 218 has not engaged extension finger 128 of door open lever 104 because security door 56 has not fully closed. Therefore, door lock switch 216 remains open. As previously stated, before drive motor 60 can be deactivated, door lock switch 216 must be closed prior to the closing of motor contact switch 236. Therefore, drive motor 60 continues to operate to reopen security door 56 from the position illustrated in FIG. 12 to the position illustrated in FIG. 8 in the manner previously described. The thin foreign object 302 can then be removed and the normal cycle of operation can be completed. It is only after door lock switch 216 has been closed that the closure of motor contact switch 236 has any significance to deactivate drive motor 60.

The combination of door lock switch 216 and motor control switch 236 operates as a security feature for the security door assembly 22 and the document dispensing device. Illegal entry into the user access compartment 20 cannot be achieved by inserting a thin foreign object, such as object 302, to deactivate drive motor 60 and then subsequently open security door 56 to obtain currency without proper authorization, since security door 56 would not have been in a previous locked position as illustrated in FIG. 4 to receive currency. The operation of security door assembly 22 as described with respect to FIG. 12 continues until the thin foreign object, such as object 302, is removed.

Documents will not be disposed into user access compartment 20 unless security door 56 is closed and locked and optical sensors 290 and 292 indicate that no foreign objects block optical sensors 290 and 292. As a further security feature of the present assembly, if a document does not break the optical sensors 290 and 292 after the dispensing cycle has begun, the dispensing cycle will automatically stop. These two security features prevent the fishing and trapping of currency.

It therefore can be seen that the present door and document receiving assembly provides for a secure door assembly for a user access compartment in an automatic document dispensing device. The assembly incorporates both security features and safety features for the user of the document dispensing device. The door and document receiving assembly is both economical to manufacture as well as reliable in its operation.

While only one embodiment of the invention has been described in detail herein and shown in the accompanying drawings, it will be evident that various further modifications are possible without departing from the scope of the invention.

What is claimed is:

1. In an automatic document dispensing device, a door assembly for a user access compartment through which documents are dispensed to the user through an opening in the user access compartment comprising:

a security door pivotally mounted by means of a shaft to the user access compartment for forceable rotation between a first position in which said security door closes the opening in the user access compartment to prevent documents from being withdrawn therefrom and a second position in which said security door is contained within the user access compartment to allow the user to gain access to the user access compartment through the opening therein for removal of documents;

means for rotating said security door between said first and second positions comprising: drive means, a door lever mounted on the shaft of said security door external of the user access compartment for imparting pivotal movement to said security door, cam means mounted to said drive means for rotation therewith and engaging said door lever to counteract the force urging said security door into said first position, such that actuation of said drive means rotates said cam means to impart rotational motion to the shaft by means of said door lever in a direction opposite the direction of a force urging said security door into said first position, a door lever contact sensor including first means mounted to said drive means and second means mounted to said door lever, said sensor responsive to the separation of said cam means and said door lever to generate a door lever separation signal; and means for locking said security door in said first position.

2. The door assembly of claim 1 wherein said means for locking said security door in said first position comprises:

a lock lever mounted to the user access compartment for selectively engaging said door lever in said security door first position to prevent opening thereof; and said cam means and said drive means being effective to disengage said lock lever from said door lever upon actuation of said drive means to permit said security door to rotate from said first position to said second position.

3. The door assembly of claim 1 and further including:

means for sensing a foreign object which prevents said security door from locking in said first position comprising first sensing means to sense the presence of the cam means in a position where said security door would be in said first position in the absence of said foreign object, and second sensing means to sense that said security door is in the first position, such that if said first sensing means senses the presence of said cam means in the position where said security door would be in said first position in the absence of said foreign object and said second sensing means does not sense that said security door is in said first position said drive means is actuated to rotate said security door to said second position.

4. The door assembly of claim 1 and further including:

means for sensing documents dispensed within the user access compartment and for actuating said drive means.

5. The door assembly of claim 1 and further including:

means disposed within the user access compartment for receiving documents dispensed into the user access compartment from the automatic document dispensing device such that as said security door rotates from said first position to said second position it urges said receiving means to a position to allow the user convenient access to the documents within the user access compartment.

6. In an automatic document dispensing device, a door assembly for a user access compartment through which documents are dispensed to the user through an opening in the user access compartment comprising:

a security door pivotally mounted to the user access compartment for rotation between a first position in which said security door closes the opening in the user access compartment to prevent documents from being withdrawn therefrom and a second position in which said security door is contained within the user access compartment to allow the user to gain access to the user access compartment through the opening therein for removal of documents;

means for rotating said security door between said first and second positions comprising a drive means, a door lever mounted to said security door external of the user access compartment for pivotal movement with said security door and cam means mounted to said drive means for engaging said door lever, such that actuation of said drive means rotates said cam means to impart rotational motion to said door lever and said security door;

means for locking said security door in said first position, comprising a lock lever mounted to the user access compartment for selectively engaging said door lever in said security door first position to prevent opening thereof, and said cam means and said drive means being effective to disengage said lock lever from said door lever upon actuation of said drive means to permit said security door to rotate from said first position to said second position;

means interconnected to said drive means for automatically reversing the direction of rotation of said security door while said security door rotates from said second position to said first position upon encountering a foreign object in the path of said security door comprising a sensor cam mounted to said cam means for rotation by said drive means, and an optical switch means mounted to said door lever such that said sensor cam engages said switch as said security door rotates between first and second positions and disengages from said switch when said security door encountes a foreign object in the path of said security door, to thereby actuate said switch to cause said drive means to reverse direction of rotation and rotate said security door to said second position.

7. In an automatic document dispensing device, a door assembly for a user access compartment through which documents are dispensed to the user through an opening in the user access compartment comprising:

a security door pivotally mounted to the user access compartment for rotation between a first position in which said security door closes the opening in the user access compartment to prevent documents from being withdrawn therefrom and a second position in which said security door is contained within the user access compartment to allow the user to gain access to the user access compartment through the opening therein for removal of documents;

means for rotating said security door between said first and second positions comprising drive means, a door lever mounted to said security door external of the user access compartment for pivotal movement with said security door, and cams means mounted to said drive means for engaging said door lever, such that actuation of said drive means rotates said cam means to impart rotational motion to said door lever and said security door;

means for locking said security door in said first position; and means for sensing a foreign object which prevents said security door from locking in said first position comprising a sensor cam mounted to said cam means for rotation by said drive means, first switch means mounted to the user access compartment adjacent said door lever such that said first switch means is actuated when said security door is in said first position, second switch means mounted to the user access compartment adjacent said sensor cam such that said second switch means is actuated when said security door is in said first position and said security door being maintained in said closed position only if said first and second switch means are simultaneously actuated by contact with said door lever and said second sensor cam, actuation of said second switch means without prior actuation of said first switch means causes said security door to rotate to said second position.

8. In an automatic document dispensing device, a door assembly for a user access compartment through which documents are dispensed to the user through an opening in the user access compartment comprising:

a mounting shaft extending into the user access compartment;

a security door for the opening in the user access compartment, said security door being pivotally mounted to said mounting shaft for rotation between a closed position for closing and locking the opening in the user access compartment to prevent documents from being withdrawn therefrom and an open position in which said security door is contained within the user access compartment for allowing the user to obtain documents from within the user access compartment through the opening therein;

drive means interconnected to said mounting shaft for rotating said security door between said closed and open positions;

a door lever pivotally mounted to said mounting shaft external of the user access compartment for transferring rotational motion from said drive means to said security door;

a drive cam interconnected to said drive means forming a surface for engagement with said door lever, wherein in the absence of a foreign object placed in the path of said security door the door lever is urged against said surface of said drive cam by the force urging said security door into the closed position, such that upon actuation of said drive means, said drive cam rotates to impart rotational motion to said door lever;

a lock lever pivotally mounted to the user access compartment for selectively engaging said door lever in said security door closed position for locking said security door to prevent user access to the user access compartment;

said drive cam including follower means for disengaging said lock lever from said door lever upon actuation of said drive means to permit said door lever to rotate thereby unlocking said security door;

means interconnected to said drive means for sensing the presence of a foreign object placed in the path of said security door while rotating from said open position to said closed position and for generating a signal to said drive means to reverse the direction of said drive means to thereby rotate said security door to said open position, said means responsive to a separation of the door lever and said surface on said drive cam resulting from the presence of said foreign object.

9. The door assembly of claim 8 and further including: means for sensing the presence of documents within the user access compartment and for generating a signal to actuate said drive means.

10. The door assembly of claim 8 wherein the separation of said door lever and said surface of said drive cam in response to the presence of a foreign object prevents said security door from locking in said closed position.

11. The door assembly of claim 8 and further including:

means disposed within the user access compartment for receiving documents dispensed into the user access compartment from the automatic document dispensing device wherein said security door rotates said document receiving means as said security door rotates from said closed position to said open position to allow the user convenient access to the documents within the user access compartment.

12. In an automatic document dispensing device, a door assembly for a user access compartment through which documents are dispensed to the user through an opening in the user access compartment comprising:

a mounting shaft extending into the user access compartment;

a security door for the opening in the user access compartment, said security door being pivotally mounted to said mounting shaft for rotation between a closed position for closing and locking the opening in the user access compartment to prevent documents from being withdrawn therefrom and an open position in which said security door is contained within the user access compartment for allowing the user to obtain documents from within the user access compartment through the opening therein;

drive means interconnected to said mounting shaft for rotating said security door between said closed and open positions;

a door lever pivotally mounted to said mounting shaft external of the user access compartment for transferring rotational motion from said drive means to said security door;

a drive cam interconnected to said drive means for engaging said door lever, such that upon actuation of said drive means, said drive cam rotates to impart rotational motion to said door lever;

a lock lever pivotally mounted to the user access compartment for selectively engaging said door lever in said security door closed position for locking said security door to prevent user access to the user access compartment;

said drive cam including means for disengaging said lock lever from said door lever upon actuation of said drive means to permit said door lever to rotate thereby unlocking said security door;

means interconnected to said drive means for sensing the presence of a foreign object placed in the path of said security door while rotating from said open position to said closed position and for generating a signal to said drive means to reverse the direction of said drive means to thereby rotate said security door to said open position wherein said means for sensing comprises: a sensor cam interconnected to said drive cam for rotation with said drive cam and switch means mounted to said door lever, such that said sensor cam continuously engages said switch means to deactivate said switch means as said security door rotates between said open and closed positions and disengages from said switch means to activate said switch means when said security door encounters the foreign object, thereby generating said signal to said drive means for reversing the direction of rotation of said security door.

13. In an automatic document dispensing device, a door and document receiving assembly for a user access compartment through which documents are dispensed to the user through an opening in the user access compartment comprising:

a security door for the opening in the user access compartment for rotation between a closed position for closing and locking the opening in the user access compartment to prevent documents from being withdrawn therefrom and an open position in which said security door is contained within the user access compartment for allowing the user to obtain documents from within the user access compartment through the opening therein;

means disposed within the user access compartment for receiving documents dispensed into the user access compartment by the automatic document dispensing device and being rotatable between a document receiving position and a document dispensing position;

drive means for rotating said security door between said closed and open positions; and a camming surface disposed on said security door for engaging lift pins disposed on said document receiving means as said security door rotates from said closed position to said open position to thereby simultaneously upwardly raise said document receiving means from said receiving position to said dispensing position.

14. The door and receiving assembly of claim 13 wherein said document receiving means is pivotally mounted independently from said security door within said user access compartment.

15. In an automatic document dispensing device, a door and currency receiving assembly for a user access compartment through which documents are dispensed to the user through an opening in the user access compartment comprising:

a mounting shaft disposed within and extending into the user access compartment;

a security door for the opening in the user access compartment pivotally mounted to said mounting shaft for rotation between a closed position for closing and locking the opening in the user access compartment to prevent documents from being withdrawn therefrom and an open position in which said security door is contained within the user access compartment for allowing the user to obtain documents from within the user access compartment through the opening therein;

drive means for rotating said security door between said closed and open positions;

a door lever pivotally mounted to said mounting shaft external of the user access compartment for transferring rotational motion from said drive means to said security door;

a drive cam interconnected to said drive means for engaging said door lever, such that upon actuation of said drive means, said drive cam rotates to impart rotational motion to said door lever;

a lock lever pivotally mounted to the user access compartment for selectively engaging said door lever in said security door closed position for locking said security door to prevent access to the user access compartment;

said drive cam including cam follower means for disengaging said lock lever from said door lever upon actuation of said drive means to permit said door lever to rotate;

a first sensor cam interconnected to said drive cam for sensing the presence of a foreign object placed in the path of said security door while rotating from said open position to said closed position;

a first switch means mounted to said door lever such that said first sensor cam continuously engages said first switch means to deactivate said first switch means as said security door rotates between said open and closed positions and disengages from said first switch means to activate said first switch means when said security door encounters the foreign object, said first switch means generating a first signal to said drive means for reversing the direction of rotation of said security door to rotate said security door to said open position;

a second sensor cam interconnected to said drive cam for sensing the presence of a foreign object preventing said security door from locking in said closed position;

a second switch means mounted to the user access compartment adjacent said door lever, such that said second switch means is actuated when said security door is in said first position;

a third switch means mounted to the user access compartment adjacent said second sensor cam, such that said third switch means is actuated when said security door is in said closed position;

said security door being maintained in said closed position only if said second and third switch means are simultaneously actuated by contact with said door lever and said second sensor cam to deactivate said drive means, actuation of said third switch means without prior actuation of said second switch means causes said drive means to rotate said security door to said open position; and means disposed within the user access compartment for receiving documents dispensed into the user access compartment by the automatic document dispensing device and being rotatable between a document receiving position and a document dispensing position.

16. The door and document receiving assembly of claim 15 wherein said third switch means generates a second signal when said third switch means is deactivated to deactivate said drive means to enable said security door to remain in said open position for a predetermined amount of elapsed time prior to automatically closing said security door upon the expiration of said elapsed time.

17. The door and document receiving assembly of claim 15 and further including:

means disposed within said user access compartment for sensing documents dispensed into the user access compartment for actuation of said drive means to unlock and rotate said security door from said closed position to said open position.

18. The door and document receiving assembly of claim 17 wherein said means for sensing documents dispensed into the user access compartment further senses the removal of documents by the user from said document receiving means to thereby actuate said drive means to rotate said security door from said open position to said closed position.

19. The door and document receiving assembly of claim 15 wherein said drive means rotates said security door between said closed and open positions while simultaneously rotating said document receiving means between said receiving and dispensing positions, such that when said security door is in said closed position said document receiving means is in said receiving position and when said security door is in said open position said document receiving means is in said dispensing position.

20. The door and document receiving assembly of claim 15 and further including:

a camming surface disposed on said security door for engaging lift pins disposed on said document receiving means as said security door rotates from said closed position to said open position to simultaneously upwardly raise said document receiving means from said receiving position to said dispensing position.

21. A user access compartment for an automatic document dispensing device comprising:

a housing having side walls, and a top, bottom, front and rear wall;

said housing front wall including an aperture for providing user access to the interior of said housing for receiving documents dispensed therein by the automatic document dispensing device;

a security door for closing and locking said aperture contained in said housing front wall, said security door being rotatable between a first position in which said security door closes said aperture in said housing front wall to prevent documents from being withdrawn from said housing and a second position in which said security door is contained within said housing to allow access to the interior of said housing for removal of documents;

means for mounting said security door to said housing;

means interconnected to said means for mounting for rotating said security door between said first and second positions such that the presence of a foreign object preventing said security door from closing said aperture causes disengagement of elements within said rotating means; and means interconnected to said rotating means for automatically reversing the direction of rotation of said security door in response to disengagement of elements in the rotating means while said security door rotates from said second position to said first position upon encountering a foreign object in the path of said security door.

22. The user access compartment of claim 2 wherein said means for rotating said security door between said first and second positions includes:

drive means;

a door lever mounted to said security door external of said housing for pivotal movement with said security door; and cam means mounted to said drive means for engaging said door lever, such that actuation of said drive means rotates said cam means to impart rotational motion to said door lever and said security door in the absence of a foreign object in the path of said security door.

23. The user access compartment of claim 22 and further including:

means for locking said security door in said first position.

24. The user access compartment of claim 23 wherein said means for locking said security door in said first position includes:

a lock lever mounted to one of said housing side walls for selectively engaging said door lever in said security door first position to prevent opening thereof; and said cam means and said drive means being effective to disengage said lock lever from said door lever upon actuation of said drive means to permit said security door to rotate from said first position to said second position.

25. The user access compartment of claim 21 wherein said means interconnected to said rotating means for automatically reversing the direction of rotation of said security door in response to disengagement of elements in the rotating means includes:

means for sensing a foreign object preventing said security door from locking in said first position comprising means to sense the presence of the rotating means in the position where said security door would be in said first position in the absence of said foreign object and means to sense that said security door is not in said first position.

26. The user access compartment of claim 21 and further including:

means disposed within said housing for receiving documents dispensed into said housing by the automatic document dispensing device.

27. The user access compartment of claim 26 and further including:

means for rotating said document receiving means as said security door rotates from said first position to said second position to allow the user convenient access to the documents within said housing.

28. In an automatic document dispensing device, a door and document receiving assembly for a user access compartment through which documents are dispensed to the user through an opening in the user access compartment comprising:

a security door for the opening in the user access compartment for rotation between a closed position for closing and locking the opening in the user access compartment to prevent documents from being withdrawn therefrom and an open position in which said security door is contained within the user access compartment for allowing the user to obtain documents from within the user access compartment through the opening therein;

document receiving means disposed within the access compartment for receiving documents dispensed into the user access compartment by the automatic document dispensing device and being rotatable between a document receiving position and a document dispensing position by said security door such that when said security door is in a closed position said document receiving means is in a receiving position and when said security door is in the open position said document receiving means is in the dispensing position;

drive means for rotating said security door between the closed and open positions and simultaneously rotating said document receiving means between the document receiving and dispensing positions; and means interconnected to said drive means for sensing the presence of an object placed in the path of said security door while rotating from the open position to the closed position and responding to disengagement of elements within said drive means resulting from the presence of the foreign object and for generating a signal in response to the disengagement to said drive means to reverse the direction of rotation of said drive means to rotate said security door to the open position.

* * * * *